US009175548B1

(12) United States Patent
Barker

(10) Patent No.: US 9,175,548 B1
(45) Date of Patent: Nov. 3, 2015

(54) FLUID TRANSFER SYSTEM FOR AN OIL DRILLING RIG

(71) Applicant: William J. Barker, Rapid City, SD (US)

(72) Inventor: William J. Barker, Rapid City, SD (US)

(73) Assignee: All In One Rentals LLC, Killdeer, ND (US)

( * ) Notice: Subject to any disclaimer, the term of this patent is extended or adjusted under 35 U.S.C. 154(b) by 229 days.

(21) Appl. No.: 13/944,066

(22) Filed: Jul. 17, 2013

(51) Int. Cl.
*B08B 9/093* (2006.01)
*E21B 43/00* (2006.01)
*B08B 3/02* (2006.01)

(52) U.S. Cl.
CPC ..... *E21B 43/00* (2013.01); *B08B 3/024* (2013.01); *B08B 9/093* (2013.01)

(58) Field of Classification Search
CPC ..... B08B 3/024; B08B 9/093; B08B 9/0933
See application file for complete search history.

(56) References Cited

U.S. PATENT DOCUMENTS 3,719,191 A * 3/1973 Zimmerly ..... 134/102.1
3,946,571 A 3/1976 Pate
4,562,791 A 1/1986 Porter
4,704,986 A 11/1987 Remp
5,248,005 A 9/1993 Mochizuki
5,253,812 A * 10/1993 Staples et al. ..... 241/21
5,409,025 A * 4/1995 Semler et al. ..... 134/111
5,993,563 A * 11/1999 Strickland et al. ..... 134/21
2006/0054202 A1 * 3/2006 Luke et al. ..... 134/167 R
2008/0047587 A1 * 2/2008 Ball ..... 134/22.1
2008/0179095 A1 * 7/2008 Eia ..... 175/66
2011/0047891 A1 3/2011 Andretich
2011/0315163 A1 12/2011 Cates

* cited by examiner

*Primary Examiner* — Kevin Murphy
(74) *Attorney, Agent, or Firm* — Neustel Law Offices

(57) ABSTRACT

A fluid transfer system for an oil drilling rig which generally includes a portable housing container which includes a pump, a manifold, an air compressor and a pressure washer. The manifold will generally include three inlets, with a first inlet connected to a drilling rig, a second inlet connected to a first storage tank such as a water tank, and the third inlet connected to a second storage tank such as an invert tank. The pump is connected to the manifold to transfer mixed fluids back out the drilling rig. The air compressor is linked to the manifold flow blowing out the fluid conduits prior to transfer of the container or to prevent spillage. The pressure washer may be used to clean various components at the drilling site. The present invention is fully portable such that it may easily be packed up and transferred between multiple drilling sites for use.

19 Claims, 3 Drawing Sheets

FLUID TRANSFER SYSTEM FOR AN OIL DRILLING RIG

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a transfer manifold housing and more specifically it relates to a fluid transfer system for an oil drilling rig which may be efficiently packed up and moved between oil drilling sites.

2. Description of the Related Art

Any discussion of the related art throughout the specification should in no way be considered as an admission that such related art is widely known or forms part of common general knowledge in the field.

Recent oil discoveries both domestically and internationally, coupled with the increasing demand for fossil fuels, have dramatically increased the drilling for oil throughout the world in recent years. For example, a recent large oil find in North Dakota has created an oil boom in the region, with a large number of oil drilling sites being established to harvest oil therefrom.

With the establishment of multiple oil drilling sites within a localized geographical region, it has become even more necessary to efficiently transfer equipment and materials therebetween to maximize oil production. In the past, permanent or semi-permanent structures have been constructed to aid in production of such oil. However, these structures have not been easily transportable between oil sites, thus requiring duplication of efforts or lost time drilling.

Because of the inherent problems with the related art, there is a need for a new and improved fluid transfer system for an oil drilling rig which may be efficiently packed up and moved between oil drilling sites.

BRIEF SUMMARY OF THE INVENTION

The invention generally relates to a fluid transfer system for an oil drilling rig which includes a portable housing container which includes a pump, a manifold, an air compressor and a pressure washer. The manifold will generally include three inlets, with a first inlet connected to a drilling rig, a second inlet connected to a first storage tank such as a water tank, and the third inlet connected to a second storage tank such as an invert tank. The pump is connected to the manifold to transfer mixed fluids back out the drilling rig. The air compressor is linked to the manifold flow blowing out the fluid conduits prior to transfer of the container or to prevent spillage. The pressure washer may be used to clean various components at the drilling site. The present invention is fully portable such that it may easily be packed up and transferred between multiple drilling sites for use.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
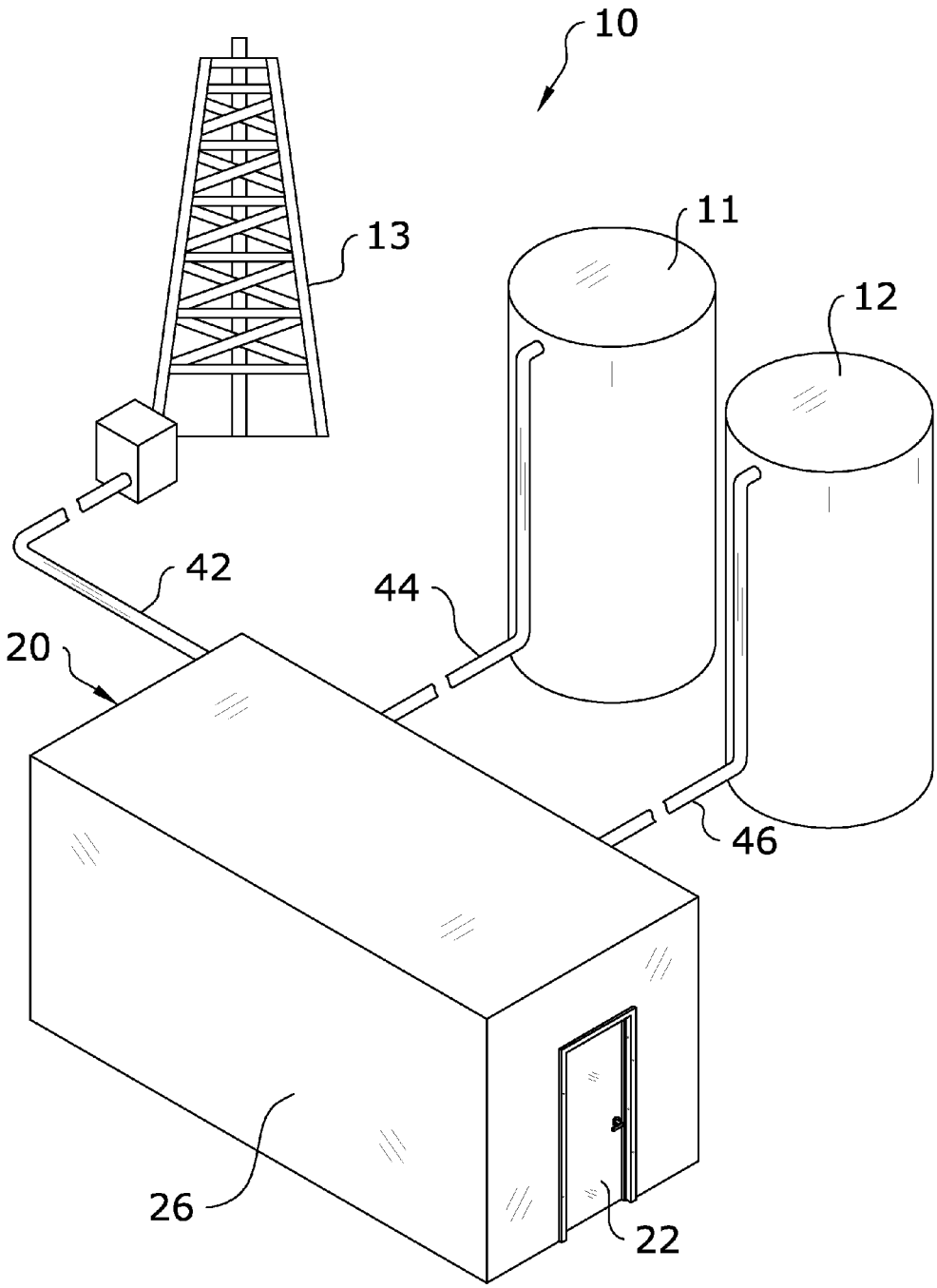
FIG. 1 is an upper perspective view of the present invention.
Figure 2:
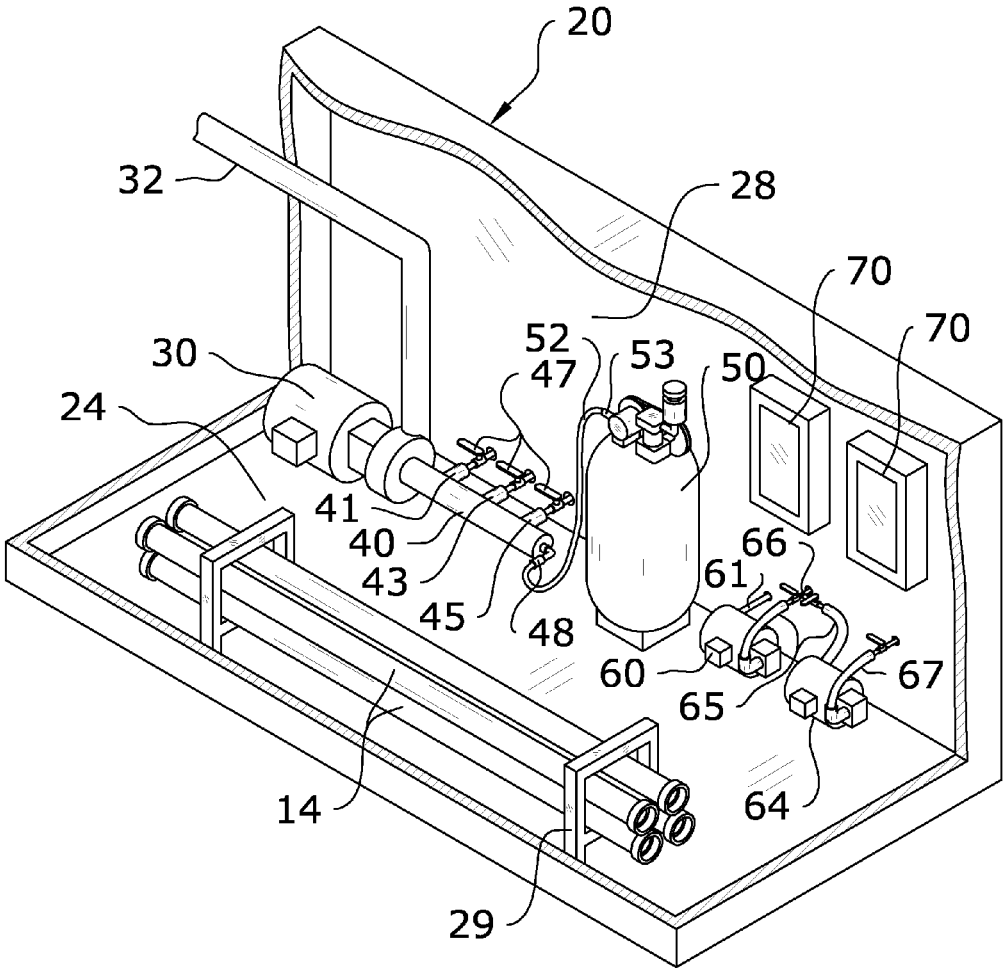
FIG. 2 is an upper perspective cutaway view of the housing container of the present invention.
Figure 3:
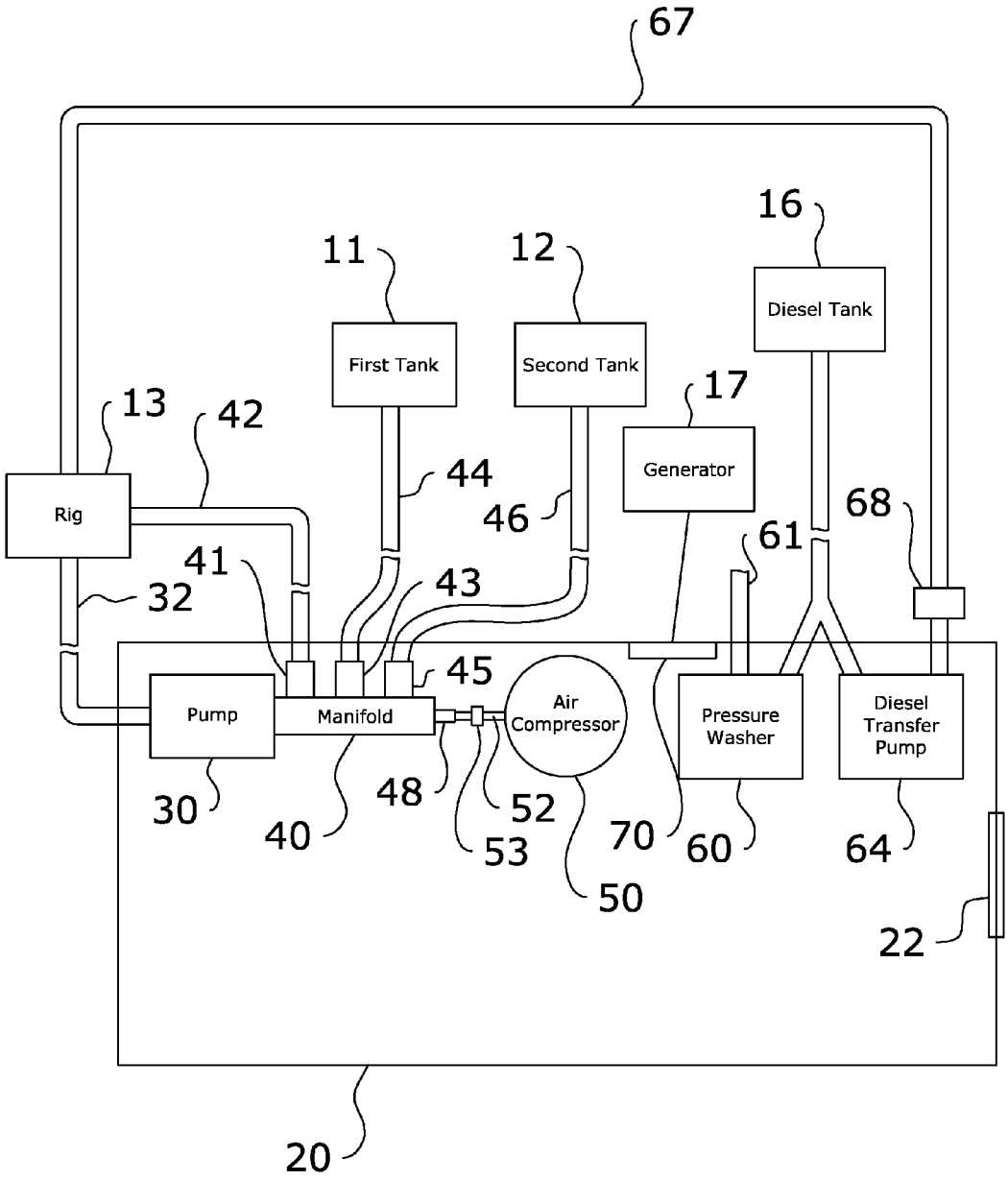
FIG. 3 is a block diagram illustrating the interconnection of the various components of the present invention.

Turning now descriptively to the drawings, in which similar reference characters denote similar elements throughout the several views, FIGS. 1 through 3 illustrate a fluid transfer system for an oil drilling rig 10, which comprises a portable housing container 20 which includes a pump 30, a manifold 40, an air compressor 50 and a pressure washer 60. The manifold 40 will generally include three inlets 41, 43, 45, with a first inlet 41 connected to a drilling rig 13, a second inlet 43 connected to a first storage tank 11 such as a water tank, and the third inlet 45 connected to a second storage tank 12 such as an invert tank. The pump 30 is connected to the manifold 40 to transfer mixed fluids back out the drilling rig 13. The air compressor 50 is linked to the manifold 40 flow blowing out the fluid conduits 42, 44, 46 prior to transfer of the container 20 or to prevent spillage. The pressure washer 60 may be used to clean various components at the drilling site. The present invention is fully portable such that it may easily be packed up and transferred between multiple drilling sites for use.

The present invention is adapted to be utilized on an oil drilling site. The drilling site will generally include a drilling rig 13 which may include a mud tank. The present invention is adapted for use on a wide range of types of drilling sites, and should not be construed as being limited for use on any particular type of drilling rig 13. The drilling site will often include upright storage tanks 11, 12 such as for storing fresh water, salt water and/or invert. While the figures illustrate only a pair of tanks 11, 12, it is appreciated that a large number of tanks 11, 12 may be utilized in connection with the present invention. Accordingly, though the figures only show a first tank 11 and a second tank 12, multiple tanks may be utilized for storing each type of fluid being used on site and with the present invention.

B. Housing Container

As best shown in FIG. 1, the present invention comprises a housing container 20 which stores the various components thereof. The housing container 20 may be comprised of various configurations, shapes and sizes. Thus, the configuration, shape and size of the housing container 20 should not be construed as being limited by the exemplary figures.

In a preferred embodiment as shown in the figures, the housing container 20 will be comprised of a standard rectangular shipping container which has been modified to suit the needs of the present invention. Preferably, the housing container 20 will be transportable, such as by truck, so as to be able to move the housing container 20 to different oil rigs for use. The housing container 20 may also be comprised of various trailer configurations. In some embodiments, the housing container 20 may include wheels and/or a trailer hitch, whereas in other configurations the housing container 20 may be adapted to rest on the bed of a truck or other vehicle for transport.

The housing container 20 will generally include at least one door 22 which leads to an inner chamber 24 which includes the various components of the present invention. The housing container 20 will generally include a front wall 26 and a rear wall 28 as shown in the figures. The housing container 20 will include air conditioning and/or heating to create a comfortable climate therein for operators of the present invention. The housing container 20 will also preferably be lighted so that it may be used both during day and night.

C. Inner Chamber

As best shown in FIGS. 2 and 3, the inner chamber 24 of the housing container 20 includes a pump 30 and manifold 40 which act to transfer various fluids between one or more storage tanks 11, 12 and a drilling rig 13. The pump 30 may be comprised of various types of pumps and will include an outlet 32 which extends out through the container 20 to be connected to the drilling rig 13 (i.e. to a mud tank).

The pump 30 includes a manifold 40 connected thereto, with the manifold 40 being connected to one or more storage tanks 11, 12 and/or a drilling rig 13. The manifold 40 may be connected directly to the pump 30 or, in some embodiments, may be integrally formed therewith.

The manifold 40 is preferably positioned adjacent one of the walls 26, 28 of the container 20, such as the rear wall 28 as shown in the figures. However, placement of the manifold 40 may vary in different embodiments of the present invention. The manifold 40, as best shown in FIGS. 2 and 3, includes a first inlet 41, a second inlet 43, and a third inlet 45, each adapted to receive fluids therein.

The first inlet 41 will generally be connected via a first fluid conduit 42 to the drilling rig 13 to receive various fluids (such as invert or fresh/salt water) therefrom for mixing in the manifold 40 prior to being pumped back via the outlet 32 of the pump 30. The second inlet 43 will generally be connected via a second fluid conduit 44 to a first storage tank 11 such as a fresh/salt water tank 11 as shown in the figures. The third inlet 45 will be connected via a third fluid conduit 46 to a second storage tank 12 such as an invert tank 12 as shown in the figures.

The fluid conduits 42, 44, 46 generally extend through openings formed in the rear wall 28 of the housing container 20. Each of the fluid conduits 42, 44, 46 or inlets 41, 43, 45 preferably include valves 47 for manually shutting off flow to the manifold 40 when needed.

The manifold 40 also preferably includes an air line connector 48 to which an air compressor 50 may be connected via an air conduit 52 as best shown in FIGS. 2 and 3. The air compressor 50 is linked with the fluid manifold 40 to blow out the fluid conduits 42, 44, 46 for cleaning, transport, or to prevent spills. The air conduit 52 preferably includes a check valve 53 to prevent backflow of any fluids from the manifold 40 into the air compressor 50.

The inner chamber 24 of the housing container 20 may also include a pressure washer 60. Various types of pressure washers 60 may be utilized. The pressure washer 60 includes a pressure washer outlet 61 which extends through the rear wall 28 of the container 20 via a hose and sprayer wand. The pressure washer 60 may be utilized to wash off various components standard to an oil drilling operation, such as shaker bins and screens. The pressure washer 60 will generally be run via diesel and thus may be connected to a diesel tank 16 exterior to the housing container 20.

The present invention may also include a diesel transfer pump 64 similarly positioned within the housing chamber 20. The diesel transfer pump 64 may include a diesel inlet 65 which is fluidly connected to the diesel tank 16. A splitter 66 may be utilized on the line from the diesel tank 16 as it enters the housing container 20 so as to connect the tank 16 to both the pressure washer 60 and the diesel transfer pump 64. A diesel outlet 67 extends from the diesel transfer pump 64 out through the housing container 20 which may be fluidly connected to the drilling rig 13 to provide diesel thereto as needed.

The outlet 67 may include a flow sensor 68 as shown in FIG. 3 to display the flow rate of diesel being pumped via the diesel transfer pump 64 to the oil rig 13. Various types of flow sensors 68 may be utilized. Preferably, the flow sensor 68 will include a display identifying gallons per minute of diesel being pumped. The diesel transfer pump 64 may also optionally include a variable frequency drive (not shown), which allows for the pump rate to be modified in response to the needs of the drilling rig 13.

Electrical power for the housing container 20 and components therein may be routed through one or more electrical panels 70 positioned within the container 20. A generator 17 is generally positioned adjacent the housing container 20 for providing electrical power thereto. In some embodiments, the electrical panels 70 may be connected directly to a power grid where a generator is not needed.

D. Operation of Preferred Embodiment

In use, the housing container 20 may be transferred directly to a drilling site and then arranged for use. The transfer hoses 14 may be removed from the hose rack 29 and utilized to connect the manifold 40 to the storage tanks 11, 12 and drilling rig 13. The pressure washer 60 and diesel transfer pump 64 may be connected to a diesel tank 16 and the electrical panels 70 connected to a generator 17 to provide power to the present invention.

Fluids such as water and/or inert may be transferred through the fluid conduits 42, 44, 46 into the manifold 40 along with any fluids needed from the drilling rig 13 such as inert. These fluids may be mixed before pumping back to the drilling rig 13 via the pump 30. The pressure washer 60 may be utilized for cleaning various oil field components and the diesel transfer pump 64 may be utilized to transfer diesel to the mud tanks of the drilling 13.

When finished at a particular site, the present invention may be packed up for transfer to another site. The manifold 40 and fluid conduits 42, 44, 46, including the transfer hoses 14, may be blown out using the air compressor 50. The transfer hoses 14 may be stored within the hose rack 29 for use at the next site. The housing container 20 may be transferred to another site, such as by being towed.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A fluid transfer system for an oil drilling rig, comprising:

a housing container;

a manifold positioned within said housing container, said manifold includes at least a first inlet and a second inlet, wherein said first inlet is adapted to be fluidly connected to a drilling rig, wherein said second inlet is adapted to be fluidly connected to a first storage tank;

a pump connected to said manifold, said pump being fluidly connected to said drilling rig;

a diesel transfer pump, said diesel transfer pump being connected at its inlet to a diesel tank and at its outlet to said drilling rig; and an air compressor, said air compressor being connected to said manifold.

2. The fluid transfer system for an oil drilling rig of claim 1, wherein said manifold includes a third inlet, wherein said third inlet is adapted to be fluidly connected to a second storage tank.

3. The fluid transfer system for an oil drilling rig of claim 2, wherein said first storage tank is comprised of a water storage tank.

4. The fluid transfer system for an oil drilling rig of claim 3, wherein said second storage tank is comprised of an invert storage tank.

5. The fluid transfer system for an oil drilling rig of claim 1, wherein said housing container is portable.

6. The fluid transfer system for an oil drilling rig of claim 1, wherein said housing container includes a pipe rack for storing a plurality of transfer hoses.

7. The fluid transfer system for an oil drilling rig of claim 1, further comprising a pressure washer positioned within said housing container.

8. The fluid transfer system for an oil drilling rig of claim 1, wherein said outlet of said diesel transfer pump includes a flow sensor.

9. The fluid transfer system for an oil drilling rig of claim 8, wherein said diesel transfer pump includes a variable frequency drive.

10. The fluid transfer system for an oil drilling rig of claim 1, further comprising a check valve positioned between said air compressor and said manifold.

11. A fluid transfer system for an oil drilling rig, comprising:

a housing container;

a manifold positioned within said housing container, said manifold includes a first inlet, a second inlet and a third inlet, wherein said first inlet is adapted to be fluidly connected to a drilling rig, wherein said second inlet is adapted to be fluidly connected to a first storage tank, wherein said third inlet is adapted to be fluidly connected to a second storage tank;

a pump connected to said manifold, said pump being fluidly connected to said drilling rig;

a pressure washer;

a diesel transfer pump, wherein an outlet of said diesel transfer pump is fluidly connected to said drilling rig; and an air compressor, said air compressor being connected to said manifold.

12. The fluid transfer system for an oil drilling rig of claim 11, wherein said first storage tank is comprised of a water storage tank.

13. The fluid transfer system for an oil drilling rig of claim 12, wherein said second storage tank is comprised of an invert storage tank.

14. The fluid transfer system for an oil drilling rig of claim 11, wherein said housing container is portable.

15. The fluid transfer system for an oil drilling rig of claim 11, wherein said housing container includes a pipe rack for storing a plurality of transfer hoses.

16. The fluid transfer system for an oil drilling rig of claim 11, wherein said outlet of said diesel transfer pump includes a flow sensor.

17. The fluid transfer system for an oil drilling rig of claim 16, wherein said diesel transfer pump includes a variable frequency drive.

18. The fluid transfer system for an oil drilling rig of claim 11, further comprising a check valve positioned between said air compressor and said manifold.

19. A fluid transfer system for an oil drilling rig, comprising:

a portable housing container;

a manifold positioned within said housing container, said manifold includes a first inlet, a second inlet and a third inlet, wherein said first inlet is fluidly connected to a drilling rig, wherein said second inlet is fluidly connected to a water storage tank, wherein said third inlet is fluidly connected to an invert storage tank;

a pump connected to said manifold, an outlet of said pump being fluidly connected to said drilling rig;

a pressure washer, wherein an inlet of said pressure washer is fluidly connected to a diesel tank and wherein an outlet of said pressure washer is comprised of a hose;

a diesel transfer pump, wherein an inlet of said diesel transfer pump is fluidly connected to said diesel tank and wherein an outlet of said diesel transfer pump is fluidly connected to said drilling rig, wherein said diesel transfer pump includes a variable frequency drive, wherein said outlet of said diesel transfer pump includes a flow sensor; and an air compressor, said air compressor being connected to said manifold via an air transfer conduit, wherein said air transfer conduit includes a check valve.

* * * * *